US006619058B2

(12) United States Patent
Cho et al.

(10) Patent No.: US 6,619,058 B2
(45) Date of Patent: Sep. 16, 2003

(54) REFRIGERATOR FOR KIMCHI AND CONTROLLING METHOD THEREFOR

(75) Inventors: Sung-ho Cho, Kwangju (KR); Cheol-hee Kim, Kwangju (KR)

(73) Assignee: Samsung Electronics Co., Ltd., Suwon (KR)

( * ) Notice: Subject to any disclaimer, the term of this patent is extended or adjusted under 35 U.S.C. 154(b) by 40 days.

(21) Appl. No.: 09/789,844

(22) Filed: Feb. 22, 2001

(65) Prior Publication Data

US 2001/0047657 A1 Dec. 6, 2001

(30) Foreign Application Priority Data

May 31, 2000 (KR) ..... 29633/2000

(51) Int. Cl.[7] ..... F25D 21/08
(52) U.S. Cl. ..... 62/156; 62/155; 62/276
(58) Field of Search ..... 62/151, 152, 155, 62/156, 234, 80, 275, 276

(56) References Cited

U.S. PATENT DOCUMENTS

| | | | | |
|---|---|---|---|---|
| 3,335,576 A | * | 8/1967 | Phillips | 62/156 |
| 4,299,095 A | * | 11/1981 | Cassarino | 62/155 |
| 4,615,179 A | | 10/1986 | Chiu et al. | 62/129 |
| 5,479,785 A | * | 1/1996 | Novak | 62/155 |
| 5,970,726 A | | 10/1999 | Derosier et al. | 62/151 |
| 6,058,724 A | | 5/2000 | Park | 62/156 |

FOREIGN PATENT DOCUMENTS

| | | |
|---|---|---|
| KR | KP 10-0160450 | 8/1998 |
| KR | KP 10-0208334 | 4/1999 |
| KR | KP 10-0229190 | 8/1999 |
| KR | KP 200-21424 | 4/2000 |

* cited by examiner

*Primary Examiner*—Harry B. Tanner
(74) *Attorney, Agent, or Firm*—Robert E. Bushnell, Esq.

(57) ABSTRACT

Disclosed is a refrigerator for kimchi, including a main body having at least one cooling chamber, an evaporator for cooling the cooling chamber, a compressor for supplying a refrigerant to the evaporator, a refrigerant tube for supplying the refrigerant from the compressor to the evaporator, and a valve installed in the refrigerant tube for controlling the supply of the refrigerant. The kimchi refrigerator further comprises a temperature sensor for detecting the temperature of the cooling chamber; a heater installed in the main body, heating and defrosting the evaporator; and a controller for controlling the heater to perform the defrosting operation when the temperature of the cooling chamber detected by the temperature sensor is not more than a predetermined temperature. With this configuration, a layer of frost frozen in the evaporators can be removed effectively, to thereby further enhance a cooling efficiency and save a consumed power.

8 Claims, 4 Drawing Sheets

REFRIGERATOR FOR KIMCHI AND CONTROLLING METHOD THEREFOR

CLAIM OF PRIORITY

This application makes reference to, incorporates the same herein, and claims all benefits accruing 35 U.S.C. §§119 from an application for Kimchi Refrigerator and Control Method Thereof earlier filed in the Korean Industrial Property Office on May 31, 2000 and there duly assigned Ser. No. 29633/2000 by that Office.

BACKGROUND OF THE INVENTION

1. Field of the Invention

The present invention relates to a refrigerator for kimchi and a controlling method therefor, and more particularly, to a refrigerator for kimchi having an evaporator and a heater and a controlling method therefor.

2. Description of the Related Art

In general, a cooling system in a refrigerator for kimchi is formed of a closed circuit including a compressor for compressing a refrigerant, a condenser for condensing the refrigerant compressed in the compressor, and an evaporator for generating a cool air using the refrigerant from the condenser. Also, the closed circuit in the cooling system is comprised of a refrigerant tube for circulating the refrigerant from the compressor. A valve for controlling the amount of the refrigerant flowing from the compressor to the evaporator according to a cooling condition of each cooling chamber is installed in the refrigerant tube.

In the above conventional kimchi refrigerator, the refrigerant is supplied to the evaporator compressor when the valve is opened and the compressor operates. Accordingly, cooling air is generated in the evaporator and thus the cooling chamber is cooled by the generated cooling have discovered that when the compressor operates over a predetermined time, the or may become frosted. As a result, a cooling efficiency of the kimchi refrigerator can be and we found that consumed power can be increased.

SUMMARY OF THE INVENTION

Accordingly, the present invention has been made keeping in mind the above problems, and it is an object of the present invention to provide a refrigerator for kimchi and a controlling method therefor, in which an evaporator is defrosted to thereby enhance an efficiency of the evaporator.

This and other objects of the present invention may be accomplished by a provision of a refrigerator for kimchi, including a main body having at least one cooling chamber, an evaporator for cooling the cooling chamber, a compressor for supplying a refrigerant to the evaporator, a refrigerant tube for supplying the refrigerant from the compressor to the evaporator, and a valve installed in the refrigerant tube for controlling the supply of the refrigerant, the kimchi refrigerator further comprising: a temperature sensor for detecting the temperature of the cooling chamber; a heater installed in the main body, for heating and defrosting the evaporator; and a controller for controlling the heater to perform the defrosting operation when the temperature of the cooling chamber detected by the temperature sensor is not more than a predetermined temperature.

Preferably, the heater is installed adjacent to the evaporator, to ripen kimchi contained in the cooling chamber.

Preferably, the heater comprises a defrosting heater installed adjacent to the evaporator, and a ripening heater installed adjacent to the cooling chamber, for ripening kimchi contained in the cooling chamber.

Effectively, the kimchi refrigerator further comprises a counter for counting an on-and-off time of the valve, wherein the controller controls the heater to perform the defrosting operation when the counted valve on-time is not less than a predetermined time and the temperature is not more than the predetermined temperature.

It is effective that the controller controls at least one of the compressors and the valve to be turned off if the heater performs the defrosting operation.

Preferably, when the compressor is turned off, the controller controls the valve to be closed after a predetermined time from the turn-off of the compressor and controls the valve to be opened prior to a predetermined time of a turn-on of the compressor.

It is effective that the controller controls the heater to stop the defrosting operation when the temperature of the cooling chamber is not less than a predetermined temperature after starting the defrosting operation of the heater.

It is preferable that the controller controls the heater to stop the defrosting operation when the operation time of the heater is not less than a predetermined time after starting the defrosting operation of the heater.

It is also preferable that the controller controls the compressor to be turned off for a predetermined time to then discharge the defrost water when the heater stops the defrosting operation.

The controller turns off the valve after a predetermined time from the turn-off the compressor.

The controller controls at least one heater to operate simultaneously to heat and defrost the evaporator, when the temperature of at least one cooling chamber detected by the temperature sensor is not more than the predetermined temperature.

According to another aspect of the present invention, this and other objects may also be accomplished by a provision of a method for controlling a refrigerator for kimchi comprising a main body having at least one cooling chamber containing kimchi therein, an evaporator for cooling the cooling chamber, a compressor for supplying a refrigerant to the evaporator, a refrigerant tube for supplying the refrigerant from the compressor to the evaporator, and a valve installed in the refrigerant tube for controlling the refrigerant from the compressor to the evaporator, for controlling the supply of the refrigerant, the method comprising the steps of: operating the compressor and opening the valve; determining whether the temperature of the cooling chamber is not more than a predetermined temperature; and heating and defrosting the evaporator if it is determined that the temperature of the cooling chamber is not more than the predetermined temperature by operating a heater provided in the main body.

Preferably, the method further comprises the steps of turning off at least one of the compressor and the valve after the evaporator starts to be defrosted, and closing the valve after a predetermined time from the turn-off of the compressor and opening the valve is opened prior to a predetermined time of a turn-on the compressor.

The method further comprises the steps of detecting the temperature of the cooling chamber after the defrosting the evaporator, and stopping the defrosting of the evaporator when the detected temperature of the cooling chamber is not less than a predetermined temperature.

It is preferable that the method further comprises the steps of defrosting the evaporator, and stopping the defrosting of the evaporator when the defrosting time is not less than a predetermined time.

Preferably, the compressor is turned off for a predetermined time to discharge defrost water when the defrosting of the evaporator is stopped.

The valve is turned off after a predetermined time from the turn-off of the compressor.

The method further comprises the steps of counting an on-time of the valve, determining whether the counted valve on-time is not less than a predetermined time, and operating the heater if it is determined that the counted valve on-time is not less than the predetermined time.

BRIEF DESCRIPTION OF THE DRAWINGS

The above object and other advantages of the present invention will become more apparent by describing the preferred embodiment thereof in more detail with reference to the accompanying drawings in which.

DETAILED DESCRIPTION OF THE INVENTION

A preferred embodiment of the present invention will be described with reference to the accompanying drawings.

In the following description, the present invention will be described only with respect to a kimchi refrigerator having a main body including two cooling chambers, a ripening heater for heating each cooling chamber and a cooling system for cooling each cooling chamber.

Figure 1:
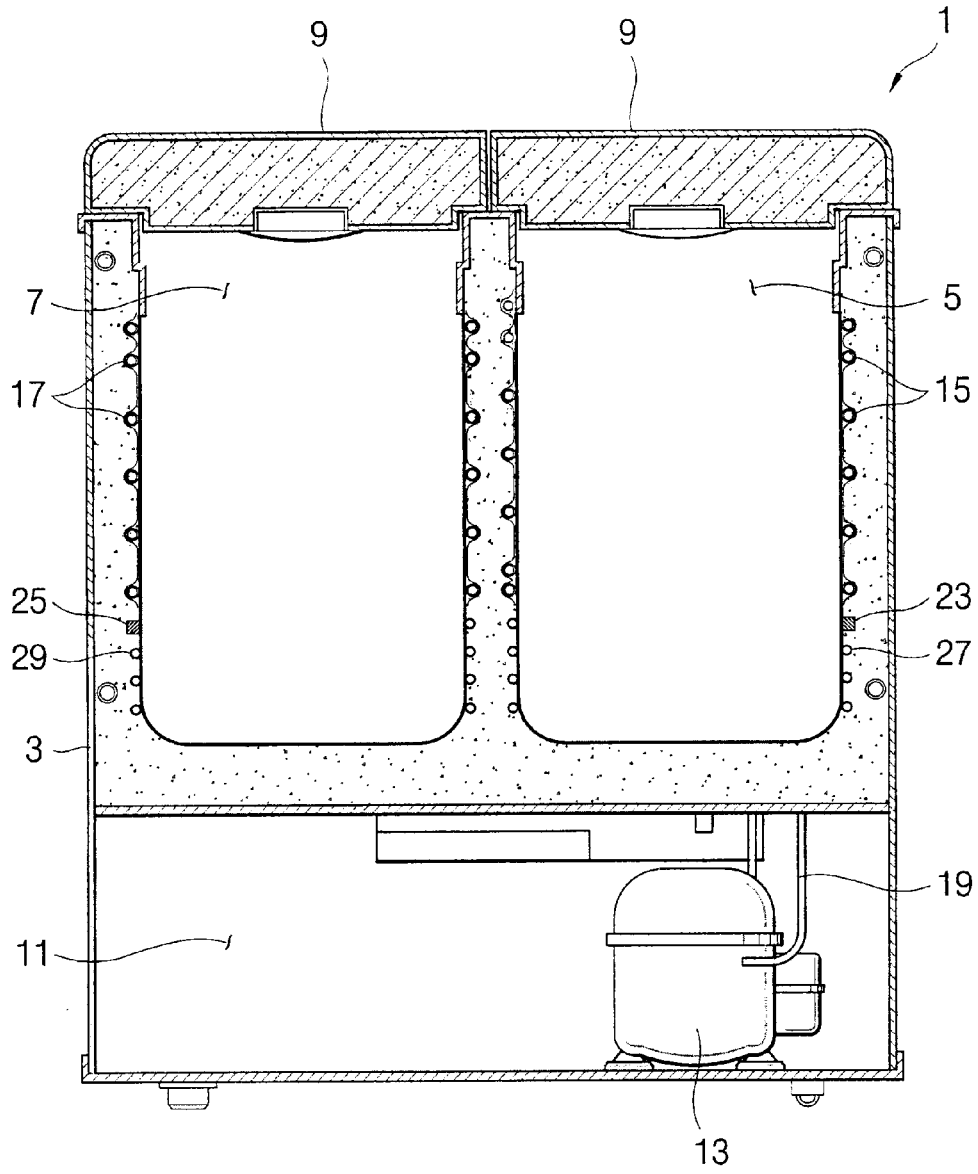
FIG. 1 is an elevational view of a refrigerator for kimchi according to the present invention.
Figure 2:
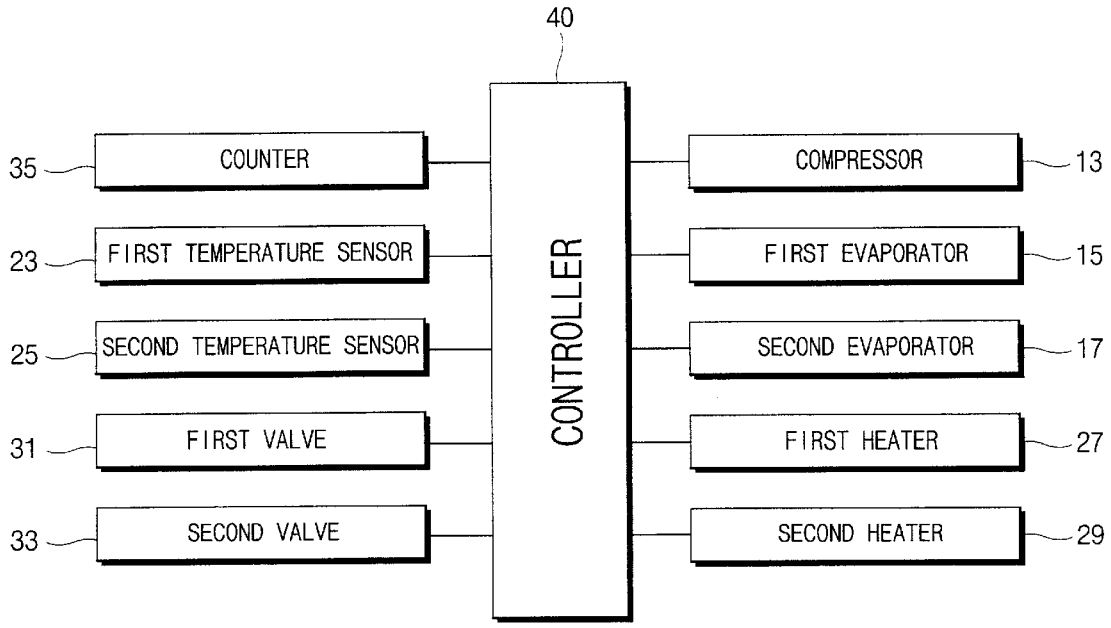
FIG. 2 is a block diagram showing the refrigerator for kimchi according to the present invention.

As shown in FIGS. 1 and 2, a kimchi refrigerator 1 includes a main body 3 having a pair of cooling chambers 5 and 7 each having an upward opening, and a pair of doors 9 rotatably installed at the upper portion of the main body for opening and closing the openings of the cooling chambers 5 and 7. On an upper-front surface of the main body 3 is provided a manipulator (not shown) for allowing a user to select a ripening time and a temperature condition according to the kind of kimchi contained in the cooling chambers 5 and 7. Between the bottom of the main body 3 and the bottom of the cooling chambers 5 and 7 is formed a component chamber 11 containing a plurality of components such as a compressor 13 for compressing a refrigerant, etc.

Also, in the main body 3 are provided first and second evaporators 15 and 17 for generating a cool air cooling the cooling chambers 5 and 7 using the refrigerant compressed in the compressor 13, and first and second temperature sensors 23 and 25 for detecting the temperatures of the cooling chambers 5 and 7. In a portion of the main body 3 are provided first and second heaters 27 and 29 for heating the evaporators 15 and 17, respectively, to remove a layer of frost adhered to the evaporators 15 and 17. Here, the first and second heaters 27 and 29 may be disposed adjacent to the evaporators 15 and 17, respectively and each of the first and second heaters 27 and 29 may function as a ripening heater for ripening kimchi stored in the cooling chambers 5 and 7 and a defrosting heater for defrosting the evaporators 15 and 17.

The refrigerant compressed in the compressor 13 circulates along a refrigerant tube 19 connecting the compressor 13 and the evaporators 15 and 17. As shown in FIG. 2, first and second valves 31 and 33 for controlling the supply of the refrigerant from the compressor 13 according to a cooling condition of the cooling chambers 5 and 7 are installed on the refrigerant tube 19. Also, the kimchi refrigerator 1 is provided with a counter 35 for counting and accumulating an opening time and a closing time of the first and second valves 31 and 33, that is, an on-and-off time.

The kimchi refrigerator 1 is provided with a controller 40 for controlling the compressor 13, the respective valves 31 and 33 and the first and second heaters 27 and 29. The controller 40 controls the compressor 13 and the respective valves 31 and 33 to operate and controls the respective heaters 27 and 29 to operate for a predetermined time, on the basis of a temperature value detected in the respective temperature sensors 23 and 25 and an opening time of the respective valves 31 and 33 counted by the counter 35.

Figure 3:
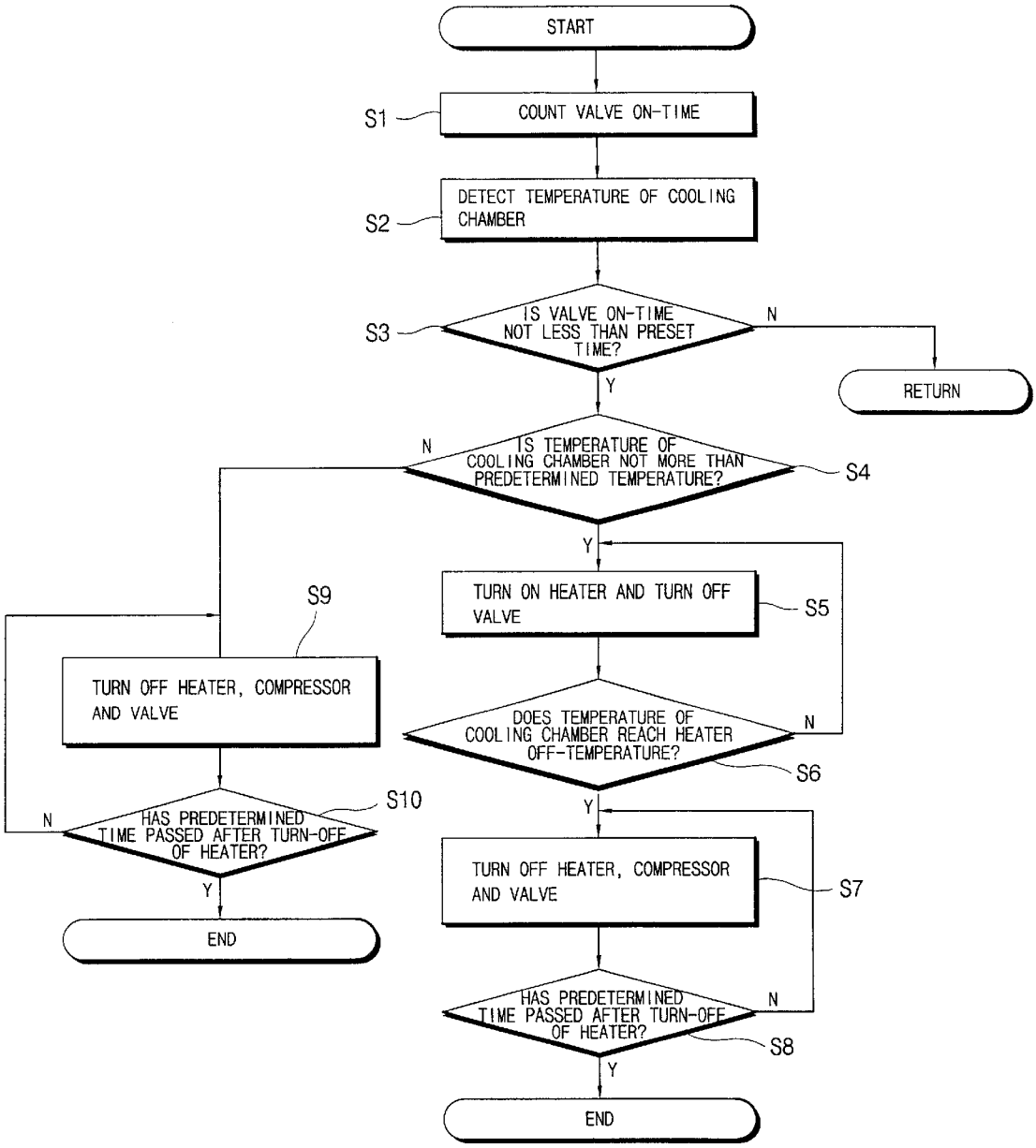
FIG. 3 is a flow chart illustrating a defrosting operation of defrosting the kimchi refrigerator according to the present invention.
Figure 4:
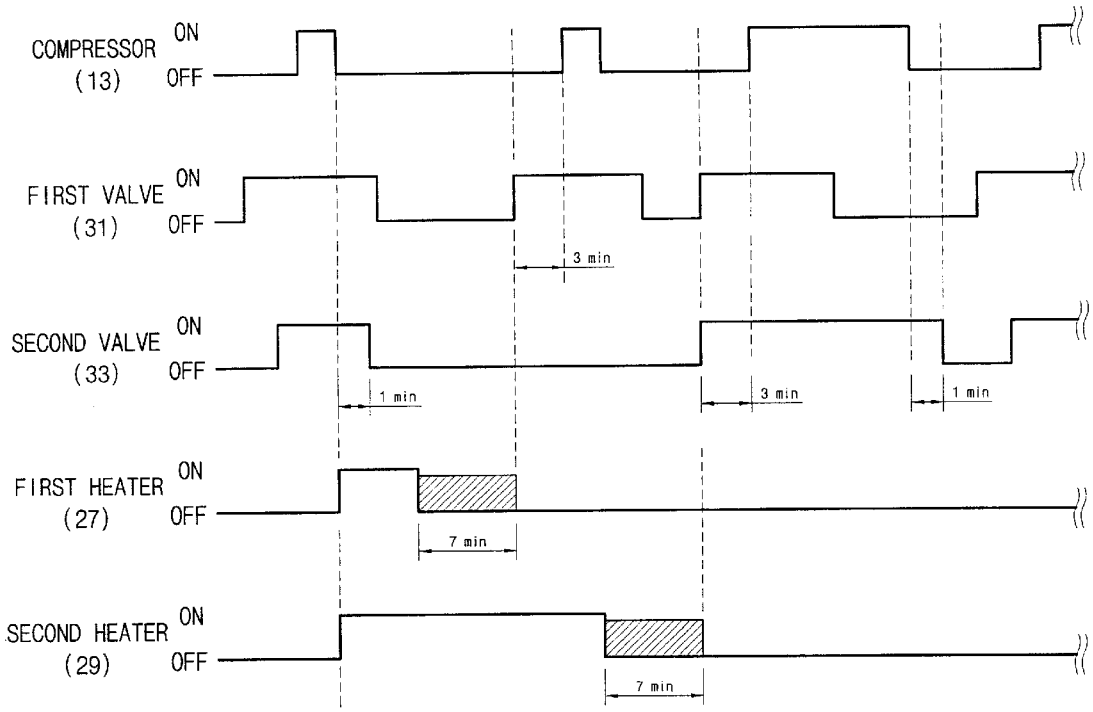
FIG. 4 is a timing diagram showing operation states of a compressor, valves and defrosting heaters in the kimchi refrigerator according to the present invention.

FIG. 3 is a flow chart illustrating a defrosting operation of the kimchi refrigerator according to the present invention, and FIG. 4 is a timing diagram showing respective operation states of the compressor, the valves and the defrosting heaters in a kimchi refrigerator according to the present invention. As shown in FIGS. 3 and 4, when power is supplied to the kimchi refrigerator 1 and a variety of operating conditions are input through the manipulator (not shown), the controller 40 controls the counter 35 to count an opening time of each of the valves 31 and 33 (S1), and controls the temperature sensors 23 and 25 to detect the temperatures of the cooling chambers 5 and 7 (S2). Then, the controller 40 determines whether the opening times of the valves 31 and 33 counted by the counter 35 are not less than a preset time, respectively (S3). Then, if the opening times of the valves 31 and 33 are not less than the preset time, the controller 40 determines whether the temperatures of the cooling chambers 5 and 7 are not more than a predetermined temperature, respectively (S4).

If it is determined that the temperatures of the cooling chambers 5 and 7 are not more than a predetermined temperature, respectively, the controller 40 controls the heaters 27 and 29 to operate and controls the valves toward the cooling chambers to be closed, to thereby defrost the evaporators 15 and 17 (S5). Here, in the case that the compressor 13 is turned off, it is preferable that the valves 31 and 33 are closed after a predetermined time from the turn-off of the compressor 13, thereby performing the turn-off of the compressor 13 more effectively. Likewise, it is effective to open the valves 31 and 33 prior to a predetermined time of re-starting the operation of the compressor 13, for stable re-starting of the compressor 13.

If the heaters 27 and 29 perform the defrosting operations, the controller 40 determines whether the temperatures of the cooling chambers 5 and 7 reach respective temperatures for turning off the heaters 27 and 29 (S6). Here, the controller 40 may determine whether respective off-times of the closed valves 31 and 33 reach a predetermined time, so as to determine whether the temperatures of the cooling chambers 5 and 7 reach the respective temperatures for turning off the heaters 27 and 29. Also, the controller 40 may control the counter 35 to count a defrosting operation time of the heaters 27 and 29 so as to determine whether the time of the defrosting operation reaches a predetermined time.

If the temperatures of the cooling chambers 5 and 7 and/or the off-times of the valves 31 and 33 reach the temperature and/or the time for stopping the defrosting operations of the heaters 27 and 29, or the defrosting operation time of the heaters reaches the predetermined time, the controller 40 controls the heaters 27 and 29 to stop the defrosting operations and controls the compressor 13 and the valves 31 and 33 to turn off(S7). If the heaters 27 and 29 stop the defrosting operations, the controller 40 discharges the defrost water outwards for a predetermined time of the stop of the heaters 27 and 29. The controller 40 determines whether a predetermined time has passed after the heaters 27 and 29 are turned off (S8). If it is determined that the predetermined time has passed, the controller 40 finishes all defrosting operations. Otherwise, the process returns to the step S7 to repeat the above steps S7 and S8 until the predetermined time has passed.

Meanwhile, if it is determined in step S4 that the temperatures of the cooling chambers 5 and 7 are more than the predetermined temperature, the controller 40 turns off the heaters 27 and 29, the compressor 13 and the valves 31 and 33 (S9). The controller 40 determines whether a predetermined time has passed after the turn-off of the heaters 27 and 29 (S10). If it is determined that the predetermined time has passed after the turn-off of the heaters 27 and 29, the controller 40 finishes the defrosting operations, otherwise the process returns to the step S9 to then turn off the heaters 27 and 29, the compressor 13 and the valves 31 and 33, until a predetermined time has passed.

As shown in FIG. 4, if a predetermined time passes after the first and second valves 31 and 33 are opened, the compressor 13 is turned on to thereby cool the respective cooling chambers 5 and 7. When the compressor 13 is turned off, the valves 31 and 33 are closed after a predetermined time (1 min.) of the turn-off of the compressor 18. Here, as can be seen in FIG. 4, after the respective heaters 27 and 29 heat the evaporators 15 and 17 for defrosting, one of the heaters, for example, the first heater 27 may be firstly turned off.

If the defrosting operation of the first heater 27 has completed, the compressor 13 and the valves 31 and 33 are turned off for a predetermined time (7 min.), to discharge the defrost water outside to prevent a re-frosting. That is, in the case that any one of the heaters 27 and 29 has stopped the defrosting operation, the compressor 13 and the valves 31 and 33 are all turned off. On the other hand, during the other heater (the second heater 29 in this embodiment) performs the defrosting operation, if the temperature of the second cooling chamber 7 rises up, the compressor 13 and the concerned valve 31 can be turned on, so as to cool the cooling chamber 7. At this time, it is preferable that the valve 33 is turned on earlier than the compressor 13 by a predetermined time (3 min.).

In the above-described embodiment, the present invention has been described with respect to the case that the temperature of each cooling chamber among a plurality of cooling chambers is detected and thus only an evaporator requiring a defrosting operation among a plurality of evaporators is operated. However, in the case that at least one evaporator requires a defrosting operation among a plurality of evaporators, all the evaporators may be heated.

In the above-described embodiment, the present invention has been described with respect to the kimchi refrigerator having all of the counter and the temperature sensors. However, it is apparent to a person skilled in the art that the present invention can have only the temperature sensors to thereby control the defrosting heaters to operate according to the temperature of the respective cooling chambers.

Also, in the above-described embodiment, the present invention has been described with respect to the case that one kind of heaters are installed to defrost the evaporators and to ripen kimchi contained in the cooling chambers. However, it is apparent to one having an ordinary skill in the art that a defrosting heater for defrosting the evaporators and a ripening heater for ripening stored kimchi can be installed for a separate use.

As described above, the kimchi refrigerator and controlling method therefor according to the present invention removes a layer of frost in the evaporators effectively, to thereby further enhance a cooling efficiency and save a consumed power.

Although the preferred embodiments of the present invention have been disclosed for illustrative purposes, those skilled in the art will appreciate that various modifications, additions and substitutions are possible, without departing from the scope and spirit of the invention as disclosed in the accompanying claims.

What is claimed is:

1. A refrigerator for kimchi, including a main body having at least one cooling chamber, an evaporator for cooling the cooling chamber, a compressor for supplying a refrigerant to the evaporator, a refrigerant tube for supplying the refrigerant from the compressor to the evaporator, and a valve installed in the refrigerant tube for controlling the supply of the refrigerant, the kimchi refrigerator comprising:

a temperature sensor for detecting the temperature of the cooling chamber;

a heater installed in the main body, heating and defrosting the evaporator, wherein said heater is installed adjacent to said evaporator, to ripen said kimchi contained in said at least one cooling chamber; and a controller for controlling the heater to perform the defrosting operation when the temperature of the cooling chamber detected by the temperature sensor is not more than a predetermined temperature; and a counter for counting an on-and-off time of the valve, wherein the controller controls the heater to perform the defrosting operation when the counted valve on-time is not less than a perdetermined time and the temperature of the cooling chamber detected by the temperature sensor is not more than the predetermined temperature.

2. The kimchi refrigerator of claim 1, wherein the controller controls the compressor and the valve to be turned off when the heater performs the defrosting operation and wherein the heater comprises a defrosting heater installed adjacent to the evaporator, and a ripening heater installed adjacent to the cooling chamber, for ripening kimchi contained in the cooling chamber.

3. The kimchi refrigerator of claim 1, wherein the heater comprises a defrosting heater installed adjacent to the evaporator, and a ripening heater installed adjacent to the cooling chamber, for ripening kimchi contained in the cooling chamber.

4. A refrigerator for kimchi, including a main body having at least one cooling chamber, an evaporator for cooling the cooling chamber, a compressor for supplying a refrigerant to the evaporator, a refrigerant tube for supplying the refrigerant from the compressor to the evaporator, and a valve installed in the refrigerant tube for controlling the supply of the refrigerant, the kimchi refrigerator comprising:

a temperature sensor for detecting the temperature of the cooling chamber;

a heater installed in the main body, heating and defrosting the evaporator; and a controller for controlling the heater to perform the defrosting operation when the temperature of the cooling chamber detected by the temperature sensor is not more than a predetermined temperature;

wherein the controller controls the heater to stop the defrosting operation when the operation time of the heater is not less than a predetermined time after starting the defrosting operation of the heater;

wherein the controller controls the compressor to be turned off for a predetermined time to then discharge defrost water when the heater stops the defrosting operations and;

wherein the controller turns off the valve after a predetermined time from the turn-off of the compressor.

5. A method for controlling a refrigerator for kimchi comprising a main body having at least one cooling chamber containing kimchi therein, and evaporator for cooling the cooling chamber, a compressor for supplying a refrigerant to the evaporator, a refrigerant tube for supplying the refrigerant from the compressor to the evaporator, and a valve installed in the refrigerant tube for controlling the supply of the refrigerant, comprising the steps of:

operating the compressor and opening the valve;

determining whether the temperature of the cooling chamber is not more than a predetermined temperature;

heating and defrosting the evaporator if it is determined that the temperature of the cooling chamber is not more than the predetermined temperature by operating a heater provided in the main body;

turning off the compressor and the valve after the evaporator starts to be defrosted;

closing the valve after a predetermined time from the turn-off of the compressor; and opening the valve prior to a predetermined time of a turn-on of the compressor.

6. A method of controlling a refrigerator for kimchi comprising a main body having at least one cooling chamber containing kimchi therein, an evaporator for cooling the cooling chamber, a compressor for supplying a refrigerant to the evaporator, a refrigerant tube for supplying the refrigerant from the compressor to the evaporator, and a valve installed in the refrigerant tube for controlling the supply of the refrigerant, comprising the steps of:

operating the compressor and opening the valve;

determining whether the temperature of the cooling chamber is not more than a predetermined temperature; and heating and defrosting the evaporator if it is determined that the temperature of the cooling chamber is not more than the predetermined temperature by operating a heater provided in the main body;

further comprising the steps of:

detecting the temperature of the cooling chamber after the defrosting the evaporator; and stopping the defrosting of the evaporator when the detected temperature of the cooling chamber is not less than a predetermined temperature;

wherein the compressor is turned off for a predetermined time to discharge defrost water when the defrosting of the evaporator is stopped; and wherein when the valve is turned off after a predetermined time from the turn-off of the compressor.

7. A method of controlling a refrigerator for kimchi comprising a main body having at least one cooling chamber containing kimchi therein, an evaporator for cooling the cooling chamber, a compressor for supplying a refrigerant to the evaporator, a refrigerant tube for supplying the refrigerant from the compressor to the evaporator, and a valve installed in the refrigerant tube for controlling the supply of the refrigerant, comprising the steps of:

operating the compressor and opening the valve;

determining whether the temperature of the cooling chamber is not more than a predetermined temperature; and heating and defrosting the evaporator if it is determined that the temperature of the cooling chamber is not more than the predetermined temperature by operating a heater provided in the main body;

further comprising the steps of:

counting the time of defrosting the evaporator; and stopping the defrosting of the evaporator when the defrosting time is not less than a predetermined time;

wherein the compressor is turned off for a predetermined time to discharge the defrost water when the defrosting of the evaporator is stopped.

8. A method for controlling a refrigerator for kimchi comprising a main body having at least one cooling chamber containing kimchi therein, an evaporator for cooling the cooling chamber, a compressor for supplying a refrigerant to the evaporator, a refrigerant tube for supplying the refrigerant from the compressor to the evaporator, and a valve installed in the refrigerant tube for controlling the supply of the regrigerant, comprising the steps of:

operating the compressor and opening the valve;

determining whether the temperature of the cooling chamber is not more than a predetermined temperature;

heating and defrosting the evaporator if it is determined that the temperature of the cooling chamber is not more than the predetermined temperature by operating a heater provided in the main body;

counting an on-time of the valve;

determining whether the counted valve on-time is not less than a predetermined time; and operating the heater if it is determined that the counted valve on-time is not less than the predetermined time.

* * * * *